US011260503B2

(12) United States Patent
Hashish et al.

(10) Patent No.: US 11,260,503 B2
(45) Date of Patent: Mar. 1, 2022

(54) ABRASIVE SLURRY DELIVERY SYSTEMS AND METHODS

(71) Applicant: Flow International Corporation, Kent, WA (US)

(72) Inventors: Mohamed A. Hashish, Bellevue, WA (US); Robert Niblock, Maple Valley, WA (US); Steven J. Craigen, Auburn, WA (US); Bruce M. Schuman, Kent, WA (US)

(73) Assignee: Flow International Corporation, Kent, WA (US)

( * ) Notice: Subject to any disclaimer, the term of this patent is extended or adjusted under 35 U.S.C. 154(b) by 795 days.

(21) Appl. No.: 15/106,244

(22) PCT Filed: Oct. 31, 2014

(86) PCT No.: PCT/US2014/063503

§ 371 (c)(1),
(2) Date: Jun. 17, 2016

(87) PCT Pub. No.: WO2015/094492

PCT Pub. Date: Jun. 25, 2015

(65) Prior Publication Data

US 2016/0339560 A1 Nov. 24, 2016

Related U.S. Application Data

(60) Provisional application No. 61/919,554, filed on Dec. 20, 2013.

(51) Int. Cl.
*B24C 7/00* (2006.01)
*B24C 5/02* (2006.01)
(Continued)

(52) U.S. Cl.
CPC ..... *B24C 7/0007* (2013.01); *B24C 1/045* (2013.01); *B24C 3/04* (2013.01); *B24C 5/02* (2013.01)

(58) Field of Classification Search
CPC ..... B24C 7/0007; B24C 7/00; B24C 7/0084; B24C 1/045; B24C 1/04; B24C 9/006; B24C 3/02; B24C 5/02; B26F 3/004
See application file for complete search history.

(56) References Cited

U.S. PATENT DOCUMENTS 3,521,407 A * 7/1970 Nalley ..... B24C 7/00 451/101
4,420,957 A 12/1983 Weber
(Continued)

FOREIGN PATENT DOCUMENTS

CN 1151131 A 6/1997
EP 2 814 637 B1 11/2015
(Continued)

OTHER PUBLICATIONS

Fairhurst et al., "DIAJET—A New Abrasive Water Jet Cutting Technique," 8th International Symposium on Jet Cutting Technology, Durham, England, Sep. 9-11, 1986, pp. 395-402.
(Continued)

*Primary Examiner* — Joel D Crandall
(74) *Attorney, Agent, or Firm* — Cozen O'Connor

(57) ABSTRACT

An abrasive slurry delivery system configured to discharge a high pressure mixture of water (30) and abrasives (54, 54') for further admixture with a flow of high pressure water (30) to generate an abrasive slurry and ultimately an abrasive slurry jet is provided. The delivery system includes a storage chamber (56), a discharge chamber (58) and a shuttle chamber (60) positioned therebetween. The shuttle chamber (60) is configured to intermittently receive abrasives (54) from the storage chamber (56) and intermittently supply the
(Continued)

abrasives (54, 54') mixed with high pressure water (30) to the discharge chamber (58) to be selectively discharged therefrom. High pressure abrasive slurry cutting systems and related methods are also provided.

35 Claims, 9 Drawing Sheets

(51) Int. Cl.
*B24C 1/04* (2006.01)
*B24C 3/04* (2006.01)

(56) References Cited

U.S. PATENT DOCUMENTS 4,780,027 A * 10/1988 Van Kuiken, Jr. ..... F42D 1/10 406/12
5,201,150 A * 4/1993 Kuboyama ..... B24C 7/0038 451/100
5,319,894 A * 6/1994 Shank, Jr. ..... B24C 5/00 451/102
5,327,755 A 7/1994 Thompson
5,643,058 A 7/1997 Erichsen et al.
6,059,641 A 5/2000 Okamoto
6,119,964 A 9/2000 Lombari
6,200,203 B1 3/2001 Xu et al.
6,371,839 B2 4/2002 Izawa et al.
6,390,898 B1 5/2002 Pieper
6,766,216 B2 7/2004 Erichsen et al.
6,997,780 B2 2/2006 Pieper
7,108,585 B1 9/2006 Dorfman et al.
7,549,911 B2 6/2009 Nguyen
7,815,490 B2 10/2010 Liu
7,934,977 B2 5/2011 Hashish
7,967,664 B2 6/2011 Elbing et al.
7,980,919 B2 7/2011 Zhou
8,308,525 B2 11/2012 Hashish et al.
8,322,700 B2 12/2012 Saberton et al.
2005/0230152 A1* 10/2005 Joslin ..... B24C 1/045 175/67
2009/0318064 A1 12/2009 Hashish
2011/0081834 A1* 4/2011 Roth ..... B24C 5/00 451/38
2012/0156969 A1* 6/2012 Liu ..... B24C 5/02 451/40
2013/0025425 A1 1/2013 Knaupp et al.
2014/0015202 A1* 1/2014 Chacko ..... F04B 1/0408 277/500

FOREIGN PATENT DOCUMENTS

WO 95/29792 A1 11/1995
WO 2015/149867 A1 10/2015

OTHER PUBLICATIONS

Hollinger et al., "Precision Cutting with a Low Pressure, Coherent Abrasive Suspension Jet," 5th American Water Jet Conference, Aug. 29-31, 1989; Toronto Canada, pp. 245-252.
Hashish, "Entrainment Versus Direct Pumping Abrasive-Fluid Machining Systems, Chapter 6, Abrasive-Fluidjet Machinery Systems; Entrainment Versus Direct Pumping," Proceedings of the 10th Annual International Conference on Jet Cutting Technology, Nov. 1990, pp. 99-113.
Bloomfield et al., "Diajet—A Review of Progress," First Asian Conference on Recent Advances in Jetting Technology, May 7-8, 1991; Singapore, pp. 21-30.
Hashish, "Cutting with High-Pressure Abrasive Suspension Jets," 6th American Water Jet Conference, Aug. 24-27, 1991; Houston, Texas, pp. 439-455.
Hashish et al., "The Next Generation of Waterjet and Abrasive-Waterjet Processing Technologies," National Center for Manufacturing Sciences, Inc., Nov. 1992, 113 pgs.
Flow Europe GmbH, "11.12 Operation Manual Abrasive Delivery System Type ADS-24-II," Abrasive Delivery System ADS-24-II, Jul. 2000; 28 pages.
CDK Corporation, "High speed response and miniature size, Small flow sensor FSM series," modified Mar. 29, 2006.

* cited by examiner

ABRASIVE SLURRY DELIVERY SYSTEMS AND METHODS

BACKGROUND

Technical Field

This disclosure is related to abrasive slurry delivery systems, devices and methods, and, in particular, to abrasive slurry delivery systems, devices and methods for supplying a high pressure abrasive slurry to a nozzle of a cutting head to generate an abrasive slurry jet for cutting or otherwise processing workpieces.

Description of the Related Art

Waterjet and abrasive waterjet cutting systems are used for cutting or processing a wide variety of materials, including stone, glass, ceramics and metals. In a typical waterjet cutting system, high-pressure water flows through a cutting head having a cutting nozzle that directs a cutting jet onto a workpiece. The system may draw or feed abrasive particles into the high-pressure waterjet to form an abrasive waterjet. More particularly, as is typical of conventional waterjet cutting systems, the cutting nozzle may include an orifice, such as a jewel orifice, through which water passes during operation to generate a high pressure waterjet. Abrasives may be introduced into a mixing chamber downstream of the orifice to entrain abrasives in the waterjet to form an abrasive waterjet. The cutting nozzle may then be controllably moved across the workpiece to cut the workpiece as desired. Systems for generating high-pressure waterjets and abrasive waterjets are currently available, such as, for example, the Mach 4™ five-axis waterjet system manufactured by Flow International Corporation, the assignee of the present application. Other examples of waterjet cutting systems are shown and described in Flow's U.S. Pat. No. 5,643,058, which is incorporated herein by reference in its entirety.

In contrast to the waterjet systems described above, other jet cutting systems are known which supply a concentrated mixture of abrasives and water, referred to herein as a "slurry," directly to the nozzle of a cutting head prior to formation of a high velocity jet for cutting or processing workpieces. As used herein, the term "abrasive slurry jet" and "abrasive slurry delivery system" are used in relation to systems and methods wherein an abrasive slurry is supplied to a nozzle of a cutting head to form a high velocity jet in contrast to many conventional abrasive waterjet systems wherein abrasives are entrained in a mixing chamber downstream of the formation a high velocity jet.

Some advantages of abrasive slurry jet cutting systems and methods include the ability to generate a relatively more slender abrasive jet to cut thinner kerfs or drill smaller holes as compared to abrasive waterjet systems. In addition, abrasive slurry jet cutting systems and methods are generally more efficient than abrasive waterjet counterparts due to the occurrence of mixing abrasives upstream of a jet generating orifice. Still further, the abrasive slurry jet cutting systems and methods can generally cut at higher speeds compared to abrasive waterjet counterparts due to a greater power density of the discharged abrasive slurry jet.

Although abrasive slurry jet cutting systems and methods are known, many conventional systems suffer from a variety of drawbacks. For example, some abrasive slurry jet systems utilize a fluidized bed approach for delivering abrasives wherein abrasives are fluidized in a pressure vessel using a rising column of high pressure water. These systems are typically quite bulky, requiring a relatively large pressure vessel. In addition, the pressure vessel must be opened periodically to refill the pressure vessel with abrasives and is unable to supply abrasive slurry during such periods, thereby leading to productivity losses.

BRIEF SUMMARY

Embodiments described herein provide abrasive slurry delivery systems and abrasive slurry jet cutting systems and related methods which are particularly well adapted to supply abrasive slurry for cutting operations in an efficient, compact and convenient form factor. Embodiments include abrasive slurry delivery systems adapted to discharge a high pressure mixture of water and abrasives for further admixture with a flow of high pressure water (e.g., 40,000 psi or higher) to generate an abrasive slurry and ultimately an abrasive slurry jet. The delivery systems include a storage chamber, a discharge chamber and a shuttle chamber positioned therebetween, the shuttle chamber being configured to intermittently receive abrasives from the storage chamber and intermittently supply the abrasives mixed with high pressure water to the discharge chamber in a sequential dosing manner.

According to some embodiments, an abrasive slurry jet cutting system may be summarized as including a cutting head having a nozzle configured to receive a flow of abrasive slurry and to generate an abrasive slurry jet during a processing operation; and a vessel assembly configured to discharge a high pressure mixture of water and abrasives for further admixture with a flow of high pressure water to form the flow of abrasive slurry. The vessel assembly may include a storage chamber to house abrasives, a discharge chamber having an outlet to selectively discharge the high pressure mixture of water and abrasives into the flow of high pressure water and toward the nozzle of the cutting head during the processing operation, and a shuttle chamber positioned therebetween. More particularly, the shuttle chamber may be positioned downstream of the storage chamber and upstream of the discharge chamber to intermittently receive the abrasives from the storage chamber and to intermittently supply the abrasives to the discharge chamber. The shuttle chamber may be coupled to a source of high pressure water to intermittently supply high pressure water to the shuttle chamber to intermittently pressurize the shuttle chamber to create the high pressure mixture of water and abrasives to be transferred to the discharge chamber.

The storage chamber, the shuttle chamber and the discharge chamber of the vessel assembly may be fixedly coupled together to form a multi-stage vessel. The multi-stage vessel may be an elongated, generally cylindrical vessel having three distinct stages arranged in a generally collinear manner. In some instances, a plurality of tie rods or other biasing devices may be arranged to compressively sandwich the shuttle chamber between the storage chamber and the discharge chamber. Each of the storage chamber, the shuttle chamber and the discharge chamber may include a tapered surface at a respective lower end thereof to funnel the abrasives or the high pressure mixture of water and abrasives downstream.

The abrasive slurry jet cutting system may further include a positioning system coupled to the cutting head to manipulate the cutting head in space and the multi-stage vessel may be attached to the positioning system. The multi-stage vessel may be attached to the positioning system such that the multi-stage vessel moves in unison with the cutting head with respect to at least one rotational or translational axis of the positioning system. The positioning system may include a robotic arm and the multi-stage vessel may be attached to the robotic arm. In other instances, the positioning system may include a carriage movably coupled to a bridge and the cutting head and the multi-stage vessel may be coupled to the carriage to move therewith.

The vessel assembly may further include a first valve between the storage chamber and the shuttle chamber and a second valve between the shuttle chamber and the discharge chamber to selectively isolate or close-off each chamber from an adjacent chamber. The abrasive slurry jet system may further include a control system that is communicatively coupled to each of the first valve and the second valve to sequentially open and close the first valve and the second valve to dose abrasives from the storage chamber to the discharge chamber via the shuttle chamber.

The shuttle chamber of the vessel assembly may include an outlet port coupled to a pressure relief or dump valve and the control system may be communicatively coupled to the pressure relief or dump valve to control the pressure relief or dump valve to selectively release pressure from the shuttle chamber to prepare the shuttle chamber to receive the abrasives from the storage chamber. The shuttle chamber of the vessel assembly may also include an inlet port coupled to a pressure supply valve and the control system may be communicatively coupled to the pressure supply valve to control the pressure supply valve to intermittently supply high pressure water to the shuttle chamber to intermittently pressurize the shuttle chamber to create the high pressure mixture of water and abrasives to be transferred to the discharge chamber. The discharge chamber of the vessel assembly may be coupled to a metering device and the control system may be communicatively coupled to the metering device to control the metering device to selectively discharge the high pressure mixture of water and abrasives into the flow of high pressure water to form an abrasive slurry.

According to some embodiments, a method of forming an abrasive slurry to be passed through a nozzle to generate an abrasive slurry jet may be summarized as including introducing abrasives into a storage chamber; depressurizing a shuttle chamber downstream of the storage chamber to prepare the shuttle chamber to receive the abrasives from the storage chamber; transferring the abrasives from the storage chamber to the shuttle chamber; isolating the shuttle chamber from the storage chamber; introducing high pressure water into the shuttle chamber to pressurize the shuttle chamber while isolated from the storage chamber to create a high pressure mixture of water and abrasives; transferring the high pressure mixture of water and abrasives from the shuttle chamber to a discharge chamber downstream of the shuttle chamber; and discharging the high pressure mixture of water and abrasives from the discharge chamber into a flow of high pressure water to mix therewith and form the abrasive slurry. Transferring the abrasives from the storage chamber to the shuttle chamber and transferring the high pressure mixture of water and abrasives from the shuttle chamber to the discharge chamber may include dosing abrasives in a sequential manner from the storage chamber to the discharge chamber via the shuttle chamber. Transferring the abrasives from the storage chamber to the shuttle chamber may occur with substantially no differential pressure between the storage chamber and the shuttle chamber and transferring the high pressure mixture of water and abrasives from the shuttle chamber to the discharge chamber may occur with substantially no differential pressure between the shuttle chamber and the discharge chamber. The method may further include maintaining the storage chamber at atmospheric pressure during operation and maintaining the discharge chamber at high pressure during operation.

According to some embodiments, a method of processing a workpiece using a high pressure abrasive slurry jet may be summarized as including dosing abrasives through a vessel assembly having a shuttle chamber provided between a storage chamber and a discharge chamber, the shuttle chamber coupled to a source of high pressure water to enable intermittent pressurization of the shuttle chamber to create a high pressure mixture of water and abrasives while dosing the abrasives; mixing the high pressure mixture of water and abrasives from the vessel assembly into a flow of high pressure water to form an abrasive slurry; passing the abrasive slurry through a nozzle to generate a high pressure abrasive slurry jet; and impinging the workpiece with the high pressure abrasive slurry jet.

DETAILED DESCRIPTION

Figure 1:
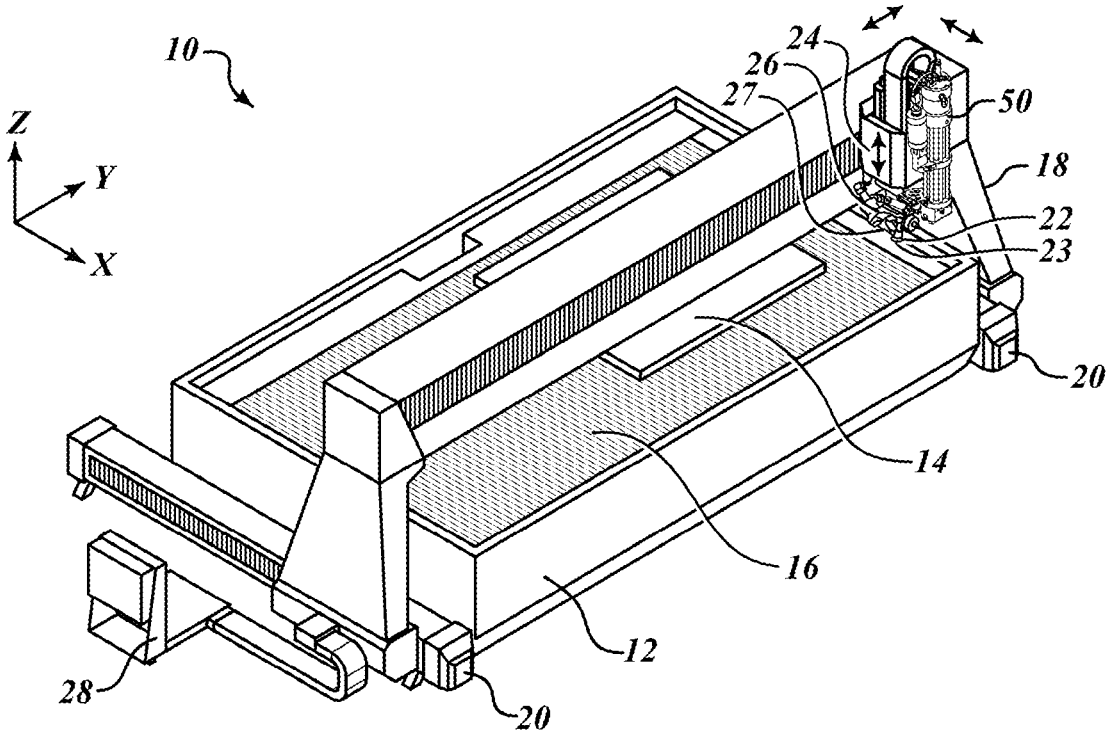
FIG. 1 is an isometric view of an abrasive slurry jet cutting system having a abrasive slurry delivery system, according to one embodiment.

In the following description, certain specific details are set forth in order to provide a thorough understanding of various disclosed embodiments.

However, one of ordinary skill in the relevant art will recognize that embodiments may be practiced without one or more of these specific details. In other instances, well-known structures associated with abrasive waterjet and abrasive slurry jet cutting systems and methods of operating the same may not be shown or described in detail to avoid unnecessarily obscuring descriptions of the embodiments. For instance, well know control systems and drive components may be provided or integrated into the abrasive slurry jet cutting systems to facilitate movement of a cutting head thereof relative to the workpiece to be processed. These systems may include drive components to manipulate the cutting head about multiple rotational and translational axes, as is common, for example, in five-axis abrasive waterjet or abrasive slurry jet cutting systems. Example abrasive slurry jet systems may include cutting heads coupled to a gantry-type motion or positioning system or a robotic arm motion or positioning system.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide abrasive slurry delivery systems and abrasive slurry jet cutting systems and related methods which are particularly well adapted to supply abrasive slurry for cutting operations in an efficient, compact and convenient form factor. Embodiments include abrasive slurry delivery systems adapted to discharge a high pressure mixture of water and abrasives for further admixture with a flow of high pressure water to generate an abrasive slurry and ultimately an abrasive slurry jet. The delivery systems include a storage chamber, a discharge chamber and a shuttle chamber positioned therebetween which is configured to intermittently receive abrasives from the storage chamber and intermittently supply the abrasives mixed with high pressure water to the discharge chamber in a sequential dosing manner.

As described herein, the term cutting head may refer generally to an assembly of components at a working end of the abrasive slurry jet cutting machine or system, and may include, for example, a nozzle of the abrasive slurry jet cutting system and surrounding structures and devices coupled directly or indirectly thereto to move in unison therewith. The cutting head may also be referred to as an end effector.

FIG. 1 shows an example embodiment of an abrasive slurry jet cutting system 10 with an abrasive slurry delivery system 50 coupled thereto. The abrasive slurry jet cutting system 10 may operate in the vicinity of a support structure 12 which is configured to support a workpiece 14 to be cut or otherwise processed by the system 10. The support structure 12 may be a rigid structure or a reconfigurable structure suitable for supporting one or more workpieces 14 (e.g., metal sheets or plates, composite aircraft parts, etc.) in a position to be cut, trimmed or otherwise processed. Examples of suitable workpiece support structures 12 include those shown and described in Flow's U.S. application Ser. No. 12/324,719, filed Nov. 26, 2008, and published as US 2009/0140482, which is incorporated herein by reference in its entirety.

In addition, the support structure 12 may be provided in the form of a catcher tank having a relatively large volume of water to dissipate the energy of the abrasive slurry jet after it passes through the workpiece 14 during processing. Examples of catcher tank systems for supporting workpieces 14 and dissipating the energy of a discharged jet are shown and described in Flow's U.S. patent application Ser. No. 13/193,435, filed Jul. 28, 2011, which is incorporated herein by reference in its entirety.

The abrasive slurry jet cutting system 10 further includes a bridge assembly 18 which is movable along a pair of base rails 20. In operation, the bridge assembly 18 moves back and forth along the base rails 20 with respect to a translational axis X to position a cutting head 22 of the system 10 for processing the workpiece 14. A tool carriage 24 is movably coupled to the bridge assembly 18 to translate back and forth along another translational axis Y, which is aligned perpendicularly to the translational axis X. The tool carriage 24 is further configured to raise and lower the cutting head 22 along yet another translational axis Z to move the cutting head 22 toward and away from the workpiece 14. One or more manipulable links or members may also be provided intermediate the cutting head 22 and the tool carriage 24 to provide additional functionality.

For example, the system 10 may include a forearm 26 rotatably coupled to the tool carriage 24 for rotating the cutting head 22 about a first axis of rotation and a wrist 27 rotatably coupled to the forearm 26 to rotate the cutting head 22 about another axis of rotation that is non-parallel to the aforementioned rotational axis. In combination, the rotational axes of the forearm 26 and the wrist 27 can enable the cutting head 22 to be manipulated in a wide range of orientations relative to the workpiece 14 to facilitate, for example, cutting of complex profiles. The rotational axes may converge at a focal point which, in some embodiments, may be offset from the end or tip of a nozzle 23 of the cutting head 22. The end or tip of the nozzle 23 of the cutting head 22 is preferably positioned at a desired standoff distance from the workpiece 14 to be processed. The standoff distance may be selected or maintained at a desired distance to optimize the cutting performance of the abrasive slurry jet.

During operation, movement of the cutting head 22 with respect to each of the translational axes X, Y, Z and one or more rotational axes may be accomplished by various conventional drive components and an appropriate control system 28. The control system 28 may generally include, without limitation, one or more computing devices, such as processors, microprocessors, digital signal processors (DSP), application-specific integrated circuits (ASIC), and the like. To store information, the control system 28 may also include one or more storage devices, such as volatile memory, non-volatile memory, read-only memory (ROM), random access memory (RAM), and the like. The storage devices can be coupled to the computing devices by one or more buses. The control system 28 may further include one or more input devices (e.g., displays, keyboards, touchpads, controller modules, or any other peripheral devices for user input) and output devices (e.g., displays screens, light indicators, and the like). The control system 28 can store one or more programs for processing any number of different workpieces according to various cutting head movement instructions. The control system 28 may also control operation of other components, such as, for example, valves of the abrasive slurry delivery systems 50, 52 described herein. The control system 28, according to one embodiment, may be provided in the form of a general purpose computer system. The computer system may include components such as a CPU, various I/O components, storage, and memory. The I/O components may include a display, a network connection, a computer-readable media drive, and other I/O devices (a keyboard, a mouse, speakers, etc.). A control system manager program may be executing in memory, such as under control of the CPU, and may include functionality related to dosing abrasives through the abrasive slurry delivery systems 50, 52 as described in more detail elsewhere.

Further example control methods and systems for abrasive waterjet cutting machines, which include, for example, CNC functionality, and which are applicable to the abrasive slurry jet cutting systems described herein, are described in Flow's U.S. Pat. No. 6,766,216, which is incorporated herein by reference in its entirety. In general, computer-aided manufacturing (CAM) processes may be used to efficiently drive or control a cutting head 22 along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of a cutting system 10 to manipulate the cutting head 22 about various translational and/or rotary axes to cut or process a workpiece 14 as reflected in the CAD model. Details of the control system 28, conventional drive components and other well known systems associated with abrasive waterjet and slurry jet cutting systems, however, are not shown or described in detail to avoid unnecessarily obscuring descriptions of the embodiments.

Although the example abrasive slurry jet cutting system 10 of FIG. 1 is shown as including a bridge assembly 18 or gantry-type motion or positioning system, it will be appreciated that embodiments of the abrasive slurry delivery systems 50 and cutting systems 10 described herein may be used in connection with many different known motion or positioning systems, including, for example, robotic arms which may be manipulated about numerous rotational and/or translational axes to position a cutting head 22 in a wide range of positions and orientations. Still further, in some instances, the abrasive slurry jet cutting systems 10 may feature a stationary cutting head 22 wherein a workpiece 14 is manipulated beneath a nozzle 23 thereof.

As can be appreciated from FIG. 1, the abrasive slurry delivery system 50 may be coupled directly to manipulable structures of the motion or positioning system of the abrasive slurry jet cutting system 10 to move in unison with the cutting head 22 with respect to at least one translational or rotational axis. For example, the abrasive slurry delivery system 50 is shown coupled to the carriage 24 to move therewith. In this manner, the abrasive slurry delivery system 50 may be controlled to move along at least the X and Y axes with the carriage 24 to remain in close proximity to the cutting head 22 throughout operation. In some instances, the abrasive slurry delivery system 50 may also be coupled to an extendible portion of the carriage 24 to move with the cutting head 22 along the Z axis. In other embodiments, and in particular those featuring robotic arm motion or positioning systems, the abrasive slurry delivery system 50 may be coupled to one or more members or links of the motion or positioning system to move in unison therewith relative to one or more translational or rotational axes. In some embodiments, an outlet of the abrasive slurry delivery system 50 may be maintained within about two feet of a nozzle 23 of the cutting head 22 throughout operation. Maintaining the outlet of the abrasive slurry delivery system 50 in close proximity to the nozzle 23 of the cutting head 22 reduces or minimizes the potential for abrasive settling that may otherwise occur if supplying high pressure abrasive slurry over relatively long distances.

In other embodiments, an abrasive slurry delivery system 50 may be located remote from the motion or positioning system and remain static relative to the coordinate system of the abrasive slurry jet cutting system 10. Irrespective of the particular arrangement, the abrasive slurry delivery system 50 is configured to supply high pressure abrasive slurry downstream toward the cutting head 22 for cutting or otherwise processing workpieces 14. It will be appreciated by those of ordinary skill in the relevant art that the terms upstream and downstream are relative positional terms which depend on a path of flowing matter (e.g., a flow of water or abrasives or a mixture thereof), with upstream being nearer the source and downstream being farther from the source in the direction of motion of the flowing water or abrasives or mixture thereof.

Figure 2A:
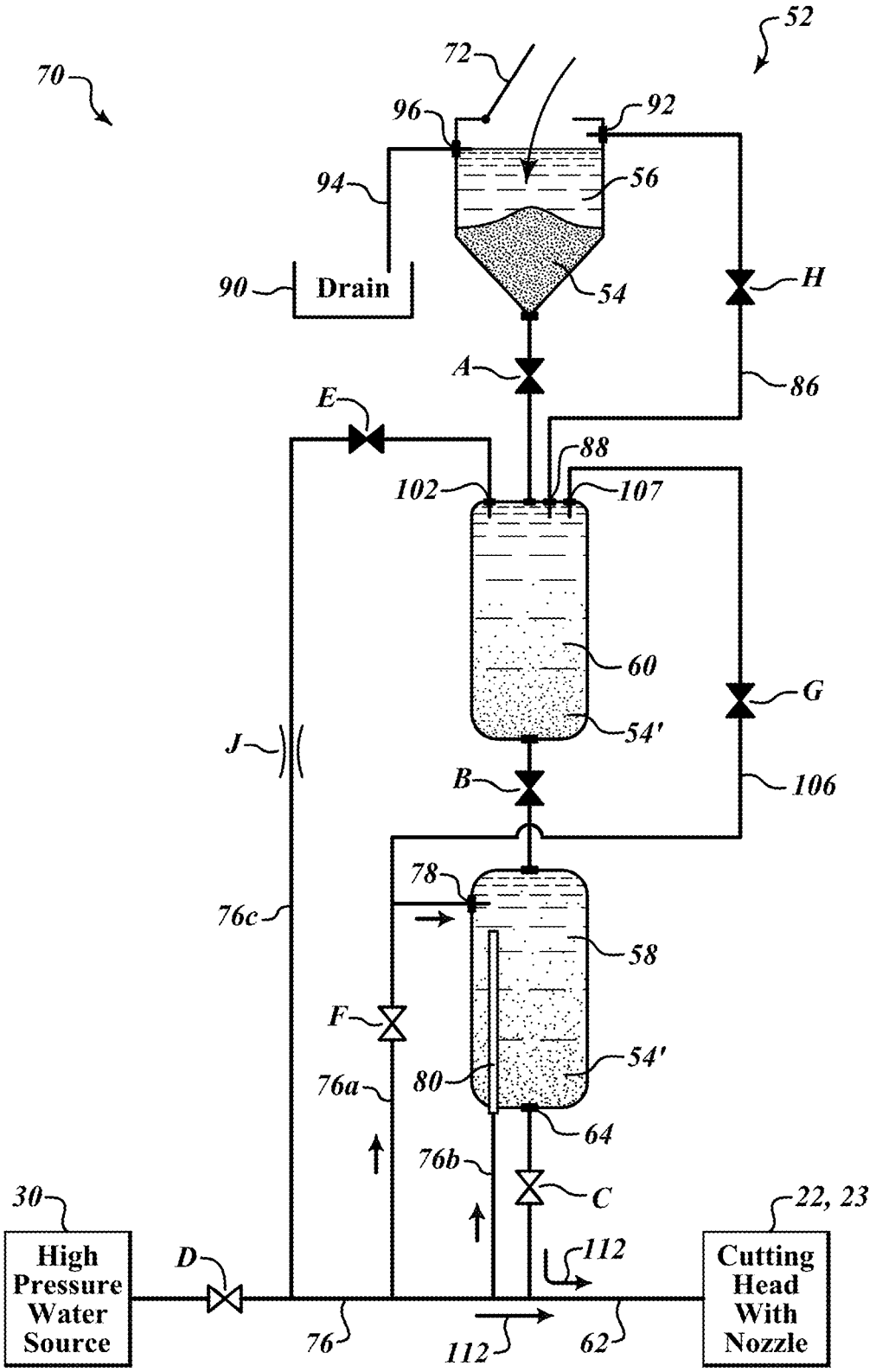
FIGS. 2A-2C are schematic diagrams of an abrasive slurry delivery system, according to one embodiment, shown in different operational configurations.
Figure 2B:
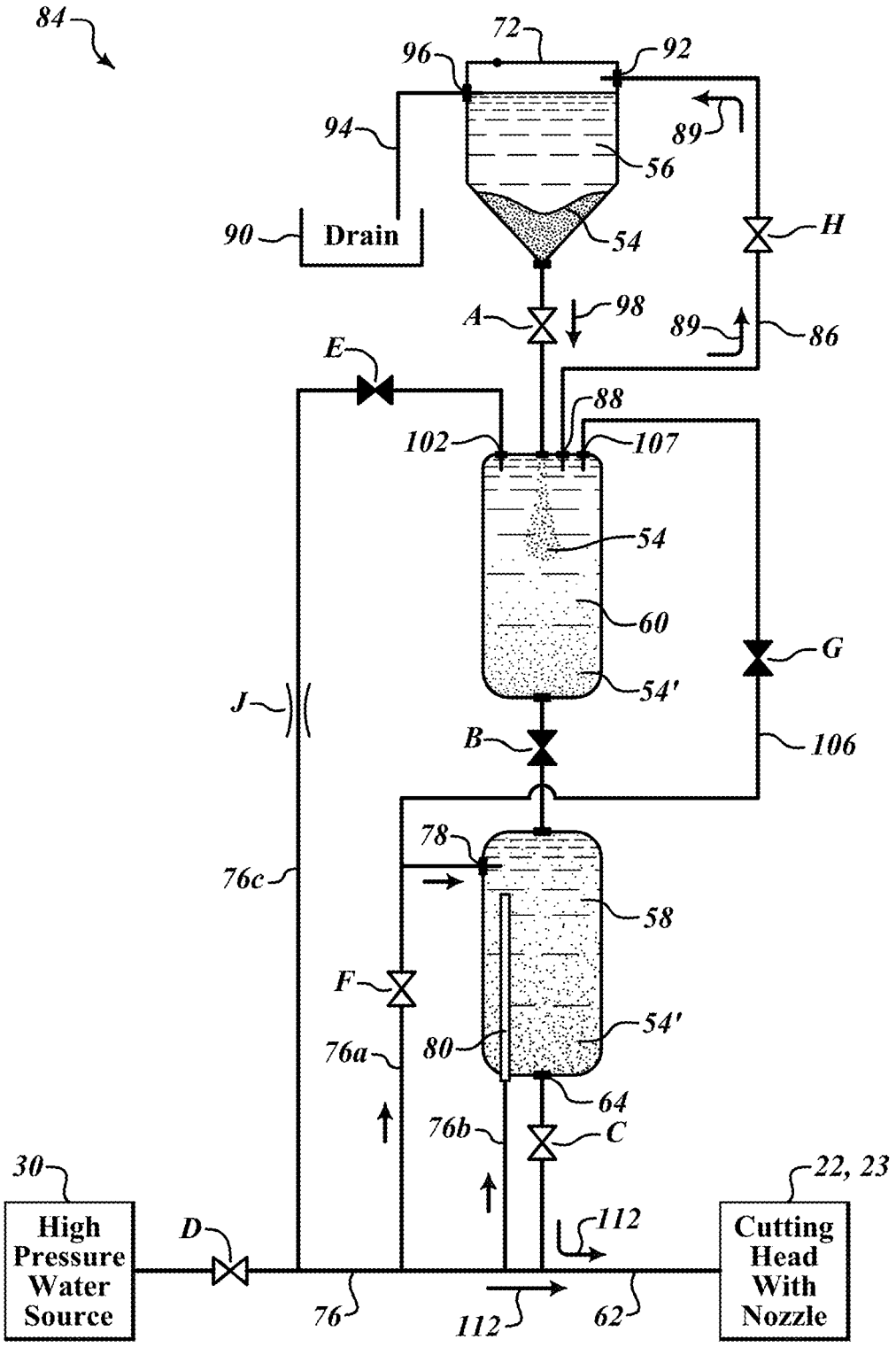
Figure 2C:
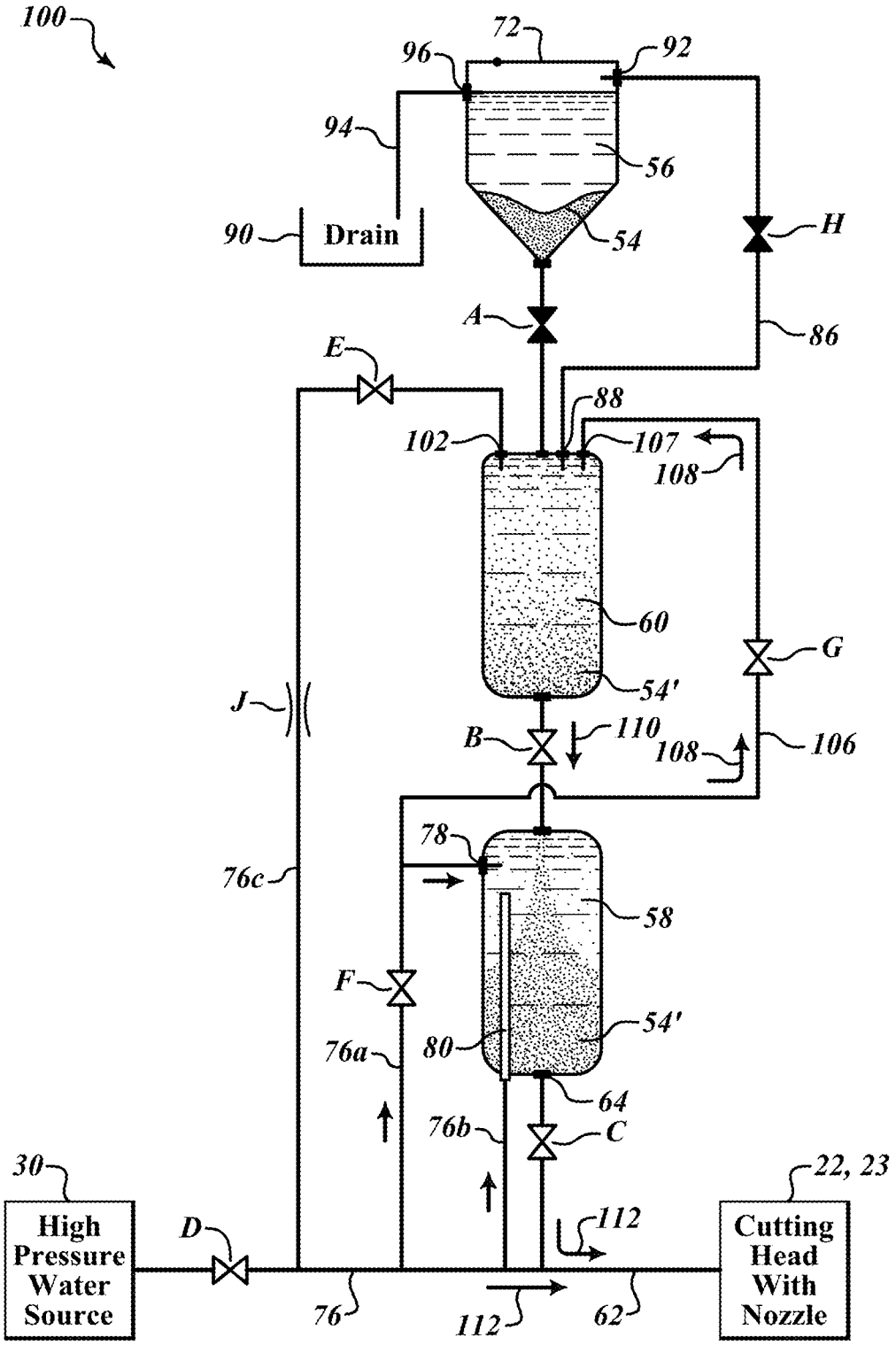
Figure 3:
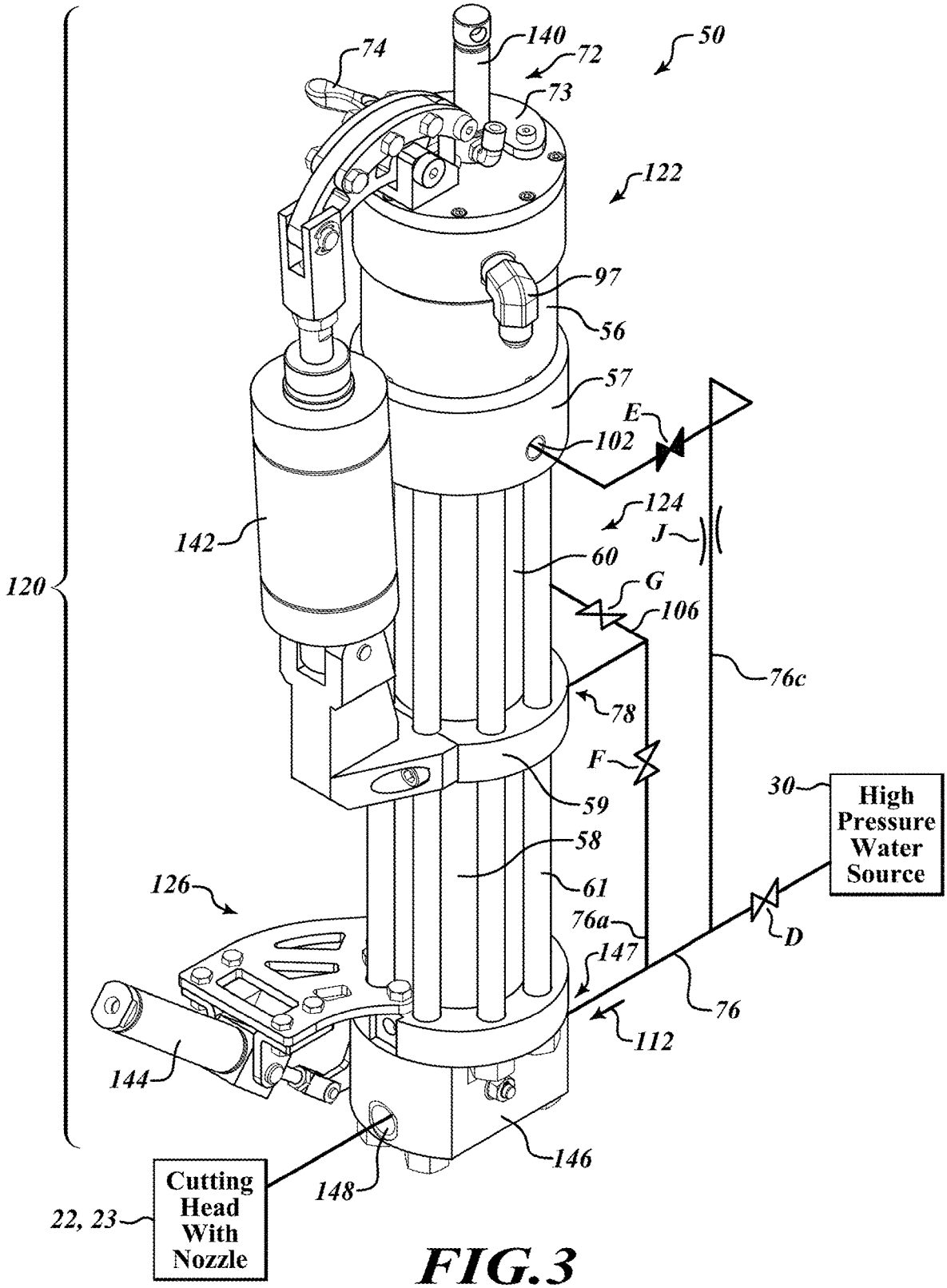
FIG. 3 is an isometric view of the abrasive slurry delivery system of the abrasive slurry jet cutting system of FIG. 1.
Figure 4:
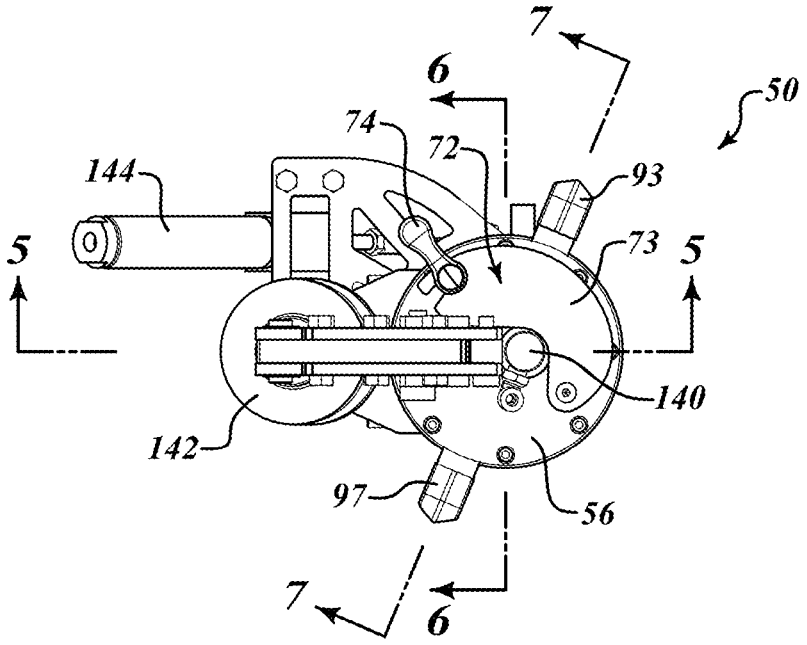
FIG. 4 is a top plan view of the abrasive slurry delivery system of FIG. 3.

FIGS. 2A-2C are schematic diagrams showing an abrasive slurry delivery system 52 illustrating dosing of abrasives 54, 54' from a storage chamber 56 to a discharge chamber 58 via an intermediate shuttle chamber 60 to supply a high pressure abrasive slurry to a nozzle 23 of a cutting head 22. Exemplary abrasives 54, 54' include, without limitation, garnet particles, silica sand, glass particles, aluminum oxide, silicon carbide, combinations thereof, and the like. The number and types of abrasives can be selected based on whether the abrasive slurry jet abrades, cuts, drills, etches, polishes, cleans, or serves another function. The abrasives 54, 54' may be substantially or predominately of a single type of abrasive or a blend of different types of abrasive materials, such as, for example, those described in Flow's U.S. application Ser. No. 12/272,577, filed Nov. 17, 2008, and published as US2010/0124872, which is incorporated herein by reference in its entirety.

The storage chamber 56 is coupled to the shuttle chamber 60 via a transfer valve A and the shuttle chamber 60 is coupled to the discharge chamber 58 via a transfer valve B such that each chamber 56, 58, 60 can be selectively isolated or closed-off from an adjacent one of the chambers 56, 58, 60 during operation. The discharge chamber 58 is further coupled to a cutting head supply line 62 by an adjustable metering valve C positioned at an outlet 64 of the discharge chamber 58. This enables abrasive slurry generated by the abrasive slurry delivery system 52 to be selectively discharged into a stream of high pressure water for further admixture with the high pressure water to be supplied to the cutting head 22. A high pressure water source 30 is provided for supplying high pressure water to the cutting head supply line 62, as well as to the shuttle and discharge chambers 58, 60, as discussed in further detail below. The high pressure water source 30, may be, for example, a direct drive or intensifier pump having a pressure rating of 40,000 psi to 100,000 psi or higher for supplying high pressure or ultra-high pressure water to the abrasive slurry delivery system 52 and the cutting head 22. Example direct drive or intensifier pumps are commercially available from Flow International Corporation, the assignee of the present application. As used herein, the term high pressure water source 30 refers to devices and systems capable of generating a source of pressurized water of at least 40,000 psi. The supply line 62 emanating from the high pressure water source 30 may include a main system valve D for selectively supplying high pressure water to the abrasive slurry delivery system 52. The main system valve D is maintained in an open condition, however, throughout normal abrasive slurry cutting operations.

During at least a portion of a cutting operation, the abrasive slurry delivery system 52 may be in a storage chamber filling configuration 70, as illustrated in FIG. 2A. In this configuration, the storage chamber 56 is isolated or closed-off from the other chambers 58, 60 and is configured to receive a supply of abrasives 54 in dry or wet form. Advantageously, abrasives 54 may be loaded or supplied to the storage chamber 56 under atmospheric pressure conditions without interrupting the supply of the abrasive slurry to the cutting head 22 that is generated by the delivery system 52. In some embodiments, for example, abrasives 54 may be manually deposited in the storage chamber 56 via an inlet 72 that is open to the external environment. In other embodiments, abrasives 54 may be gravity fed or otherwise delivered to the storage chamber 56 by automated or semi-automated delivery systems. The abrasive delivery systems may include, for example, an abrasive hopper or silo that is coupled to the storage chamber 56 by an abrasive supply line that continuously or intermittingly supplies abrasives thereto.

While in the storage chamber filling configuration 70 illustrated in FIG. 2A, the abrasive slurry delivery system 52 may continue to supply abrasive slurry towards the cutting head 22 as needed for a desired cutting or processing operation. In this manner, the discharge chamber 58 is also isolated from the other chambers 56, 60 with the interior charged with high pressure water emanating from the high pressure water source 30. More particularly, a high pressure water supply line 76 having one or more branches 76*a*, 76*b* may supply high pressure water to the discharge chamber 58 to reduce or substantially eliminate a pressure differential across the metering valve C to assist in moving a high pressure mixture of water and abrasives contained in the discharge chamber 58 through the metering valve C for further admixture with the flow of high pressure water to generate a high pressure abrasive slurry that is particularly well suited for discharge through a nozzle 23 of the downstream cutting head 22. In the schematic illustration of FIG. 2A, for example, the discharge chamber 58 is supplied with high pressure water from a first branch 76*a* of the supply line 76 through a supply port 78 of the discharge chamber 58. In addition, a second branch 76*b* of the supply line 76 is coupled to a riser conduit 80 within the discharge chamber 58. A valve F may be provided in the first branch 76*a* between the supply port 78 and the source of high pressure water 30 to selectively close-off the first branch 76*a* from supplying high pressure water to the storage chamber 58.

During at least a portion of a cutting operation, the abrasive slurry delivery system 52 may be in a shuttle chamber filling configuration 84, as illustrated in FIG. 2B. In this configuration, the shuttle chamber 60 is isolated or closed-off from the discharge chamber 58 but opened to the storage chamber 56 to receive abrasives 54 therefrom. More particularly, transfer valve A positioned between the storage chamber 56 and the shuttle chamber 60 is opened to allow abrasives 54 in the storage chamber 56 to move into the shuttle chamber 60. Prior to transfer of the abrasives 54, however, the shuttle chamber 60 may be vented to atmospheric pressure to minimize or substantially eliminate a pressure differential across transfer valve A. For example, a dump valve H may be provided within an auxiliary return line 86 coupled to an outlet or vent port 88 of the shuttle chamber 60 and opened to vent the interior of the shuttle chamber 60 to atmospheric pressure, as illustrated by the arrows labeled 89. The shuttle chamber 60 may be vented directly or indirectly to a drain 90, catch basin or other structure. For instance, in the example embodiment illustrated in FIG. 2B, the shuttle chamber 60 is shown as being vented to a drain 90 via the intermediary of the storage chamber 56. For this purpose, the auxiliary return line 86 may be coupled to an inlet port 92 of the storage chamber 56 and a separate drain line 94 may be provided between an outlet or vent port 96 of the storage chamber 56 and the drain 90 to route vented matter away from the abrasive slurry delivery system 52. With the pressure differential across the transfer valve A minimized or substantially eliminated, abrasives 54 stored in the storage chamber 56 may be readily transferred to the shuttle chamber 60, as illustrated by the arrow labeled 98 in FIG. 2B.

During at least a portion of a cutting operation, the abrasive slurry delivery system 52 may be in a discharge chamber filling configuration 100, as illustrated in FIG. 2C. In this configuration, the shuttle chamber 60 is isolated or closed-off from the storage chamber 56 but opened to the discharge chamber 58 to supply abrasives 54' thereto. More particularly, transfer valve B positioned between the shuttle chamber 60 and the discharge chamber 58 is opened to allow a high pressure mixture of water and abrasives 54' in the shuttle chamber 60 to move into the discharge chamber 58. Prior to transfer of high pressure mixture of water and abrasives 54', however, the shuttle chamber 60 may be exposed to the high pressure water source 30 to minimize or substantially eliminate a pressure differential across the transfer valve B. For example, a high pressure supply line 76*c* in fluid communication with the high pressure water source 30 may be coupled to a pressure port 102 of the shuttle chamber 60 to selectively supply high pressure water thereto. A pressure supply valve E may be provided within the high pressure supply line 76*c* to selectively supply high pressure water to the shuttle chamber 60, the pressure supply valve E being in an open position when the abrasive slurry delivery system 52 is in the discharge chamber filling configuration 100 shown in FIG. 2C. One or more orifices J, restrictors or other flow control devices may also be provided within the high pressure supply line 76*c* to control, manipulate or regulate the flow of high pressure water to the shuttle chamber 60.

Additionally, a return line 106 may be provided between the discharge chamber 58 and the shuttle chamber 60 at return port 107 to enable water or a mixture of water and abrasives to return to the shuttle chamber 60 during the discharge chamber 58 filling process, as represented by the arrows labeled 108. A return valve G is provided within the return line 106 for this purpose, namely to selectively enable water or a mixture of water and abrasives to return to the shuttle chamber 60. With the pressure differential across the transfer valve B minimized or substantially eliminated, the high pressure mixture of water and abrasives 54' in the shuttle chamber 60 may be readily transferred to the discharge chamber 58, as illustrated by the arrow labeled 110 in FIG. 2C.

It will be appreciated that the abrasive slurry delivery system 52 is well suited for dosing abrasives 54, 54' from the storage chamber 56 to the discharge chamber 58 via the intermediate shuttle chamber 60 without interrupting the ability of the discharge chamber 58 to supply a high pressure mixture of water and abrasives via the metering valve C during cutting operations. In one stage of the dosing process, for example, the shuttle chamber 60 is isolated from the discharge chamber 58 and vented to atmospheric pressure to prepare the shuttle chamber 60 to receive abrasives 54 from the storage chamber 56 via the transfer valve A, while a high pressure mixture of water and abrasives 54' nevertheless remains available in the discharge chamber 58 for selective discharge via the metering valve C. In another stage of the dosing process, the shuttle chamber 60 is isolated from the storage chamber 56 and high pressure water is introduced to prepare the shuttle chamber 60 to supply a mixture of water and abrasives 54' to the discharge chamber 58 via the transfer valve B. Likewise, in this stage, a high pressure mixture of water and abrasives 54' nevertheless remains available in the discharge chamber 58 for selective discharge via the metering valve C. These two stages can be repeated continuously or intermittingly to prepare a steady supply of the high pressure mixture of water and abrasives 54' for subsequent discharge through the metering valve C. Advantageously, dry or wet abrasives 54 can be deposited as needed into the storage chamber 56 under atmospheric pressure conditions, again without disrupting the ability to continuously supply a high pressure mixture of water and abrasives 54' through the metering valve C to generate a high pressure abrasive slurry and ultimately a high pressure abrasive slurry jet for cutting or otherwise processing workpieces 14.

In view of the above, a method of forming an abrasive slurry to be passed through a nozzle 23 of a cutting head 22 to generate an abrasive slurry jet may include introducing abrasives 54 into a storage chamber 56 and depressurizing a shuttle chamber 60 downstream of the storage chamber 56 to prepare the shuttle chamber 60 to receive the abrasives 54 from the storage chamber 56. The method may further include transferring the abrasives 54 from the storage chamber 56 to the shuttle chamber 56 via an intermediate transfer valve A and then isolating the shuttle chamber 60 from the storage chamber 56. After isolating the shuttle chamber 60 from the storage chamber 56, the method may continue by introducing high pressure water into the shuttle chamber 60 to pressurize the shuttle chamber 60 to create a high pressure mixture of water and abrasives 54' therein. Next, the high pressure mixture of water and abrasives 54' may be transferred from the shuttle chamber 60 to a discharge chamber 58 downstream of the shuttle chamber 60 via an intermediate transfer valve B. The method may conclude with discharging the high pressure mixture of water and abrasives 54' from the discharge chamber 58 into a flow of high pressure water, represented by the arrow labeled 112, to mix therewith and form the abrasive slurry, or the method may repeat to successively dose abrasives 54, 54' through the chambers 56, 58, 60.

According to one embodiment, a method of processing a workpiece using a high pressure abrasive slurry jet is also provided. The method includes dosing abrasives through an abrasive slurry delivery system 52 having a shuttle chamber 60 provided between a storage chamber 56 and a discharge chamber 58, the shuttle chamber 60 being coupled to a source of high pressure water to enable intermittent pressurization of the shuttle chamber 60 to create a high pressure mixture of water and abrasives 54'. The method further includes mixing the high pressure mixture of water and abrasives 54' from the abrasive slurry delivery system 52 into a flow of high pressure water, as represented by the arrows labeled 112, to form an abrasive slurry and then passing the abrasive slurry through a nozzle 23 of a cutting head 22 to generate a high pressure abrasive slurry jet. The method may continue with impinging a workpiece 14 with the high pressure abrasive slurry jet to cut or otherwise process the workpiece 14.

FIGS. 3 through 7 show further details of the example embodiment of the abrasive slurry delivering system 50 shown in FIG. 1, which is represented schematically in FIGS. 2A-2C. For ease of understanding, identical reference characters are used to designate those features of the abrasive slurry delivering system 50 represented schematically in FIG. 2, and should not be considered to limit embodiments of the systems and methods described in connection with FIGS. 2A-2C to the specific structures shown in FIGS. 3 through 7. Rather, the delivery system 50 shown in FIGS. 3 through 7 is provided as a non-limiting example.

As shown in FIGS. 3 through 7, the slurry delivery system 50 may comprise a vessel assembly 120 which includes a storage chamber 56, a discharge chamber 58, and a shuttle chamber 60 positioned therebetween. The storage chamber 56 may be provided at an upper end 122 of the vessel assembly 120 to receive and house abrasives 54 for subsequent dosing of the abrasives 54 downstream. Advantageously, abrasives 54 may be loaded or supplied to the storage chamber 56 under atmospheric pressure conditions without interrupting the supply of abrasive slurry generated by the delivery system 50 to the cutting head 22.

In some embodiments, for example, abrasives may be manually deposited in the storage chamber 56 via an inlet 72 that may be opened to the external environment. For example, in the illustrated embodiment of FIGS. 3 through 7, an inlet 72 is provided in the form of a movable cover 73 having a releasable clamp device 74 for selectively locking and unlocking the cover 73. In this manner, the cover 73 can be quickly and conveniently unlocked and opened to receive abrasives 54, and then closed and locked to enclose the abrasives 54 within the storage chamber 56. In other embodiments, abrasives 54 may be gravity fed or otherwise delivered to the storage chamber 56 by automated or semi-automated delivery systems (not shown). Such abrasive delivery systems may include, for example, an abrasive hopper or silo that is coupled to the storage chamber 56 by an abrasive supply line that continuously or intermittingly supplies abrasives thereto whether under the influence of gravity or other assistive forces. Monitoring systems may also be provided to sense a level of the abrasives 54 within the storage chamber and to provide a signal for adding additional abrasives 54 when below a threshold level.

The shuttle chamber 60 is positioned downstream of the storage chamber 56 within a central portion 124 of the vessel assembly 120 to intermittently receive abrasives 54 from the storage chamber 56 and to intermittently supply the abrasives 54' to the discharge chamber 58 under high pressure conditions. For this purpose, the shuttle chamber 60 is coupled to a source of high pressure water 30 to enable selective and intermittent supply of high pressure water to the shuttle chamber 60 to intermittently pressurize the shuttle chamber 60 and create or generate a high pressure mixture of water and abrasives 54' for subsequent transfer to the discharge chamber 58. The high pressure water source 30, may be, for example, a direct drive or intensifier pump having a pressure rating within a range of 40,000 psi to 100,000 psi or higher.

The discharge chamber 58 is provided downstream of the shuttle chamber 60 at a lower end 126 of the vessel assembly 120. The discharge chamber includes an outlet 64 coupled to a metering valve C for selectively discharging the high pressure mixture of water and abrasives 54' received from the shuttle chamber 60 into a flow of high pressure water (represented by the arrows labeled 112 in FIGS. 3 and 5-7) and toward a nozzle 23 of a cutting head 22 for cutting or other processing operations. The flow of high pressure water 112 that mixes with the high pressure mixture of water and abrasives 54' from the delivery system 50 preferably emanates from the same source of high pressure water 30 used to selectively pressurize the shuttle chamber 60.

Figure 6:
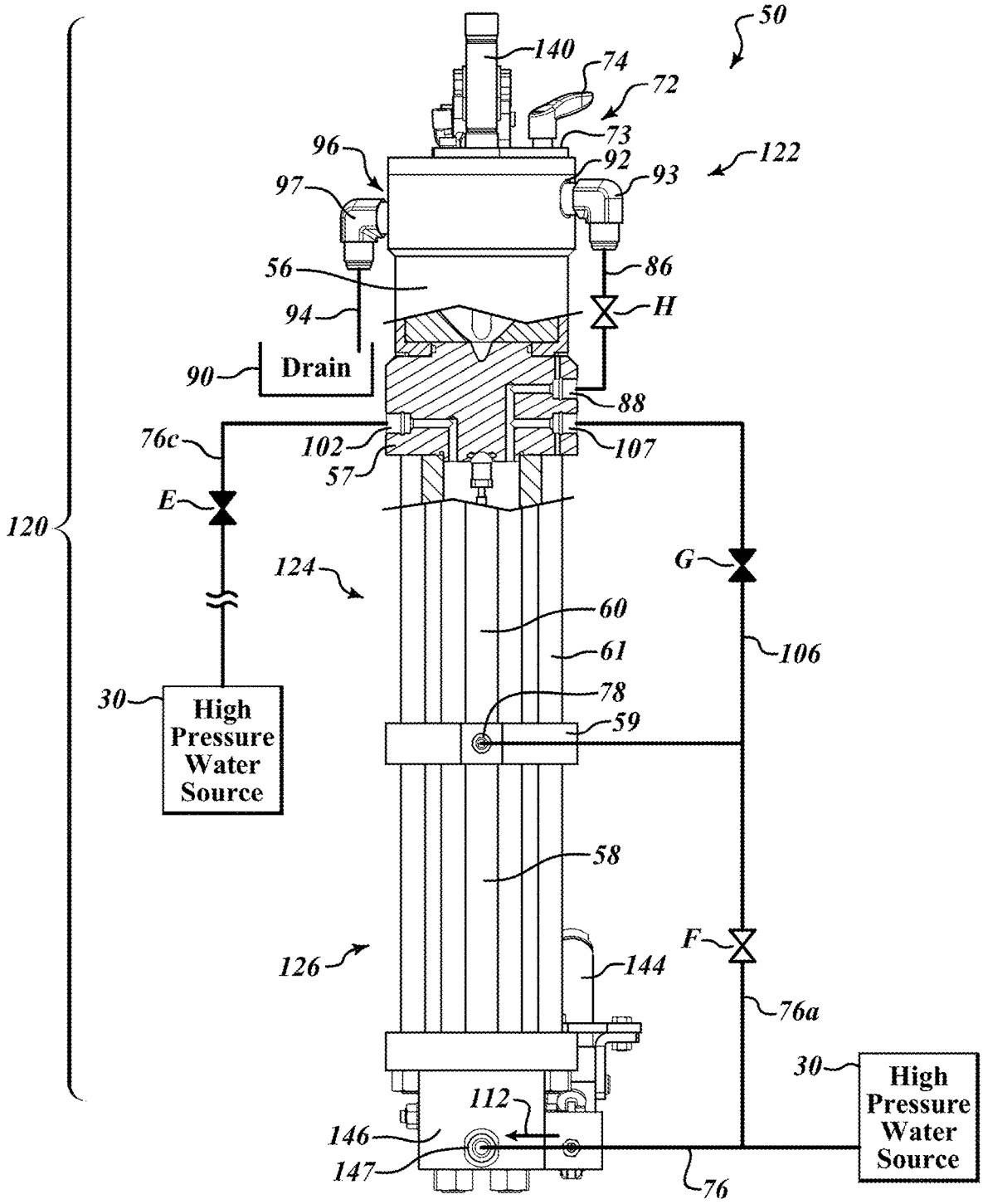
FIG. 6 is a partial cross-sectional view of the abrasive slurry delivery system of FIG. 3 taken along line 6-6 of FIG. 4.
Figure 7:
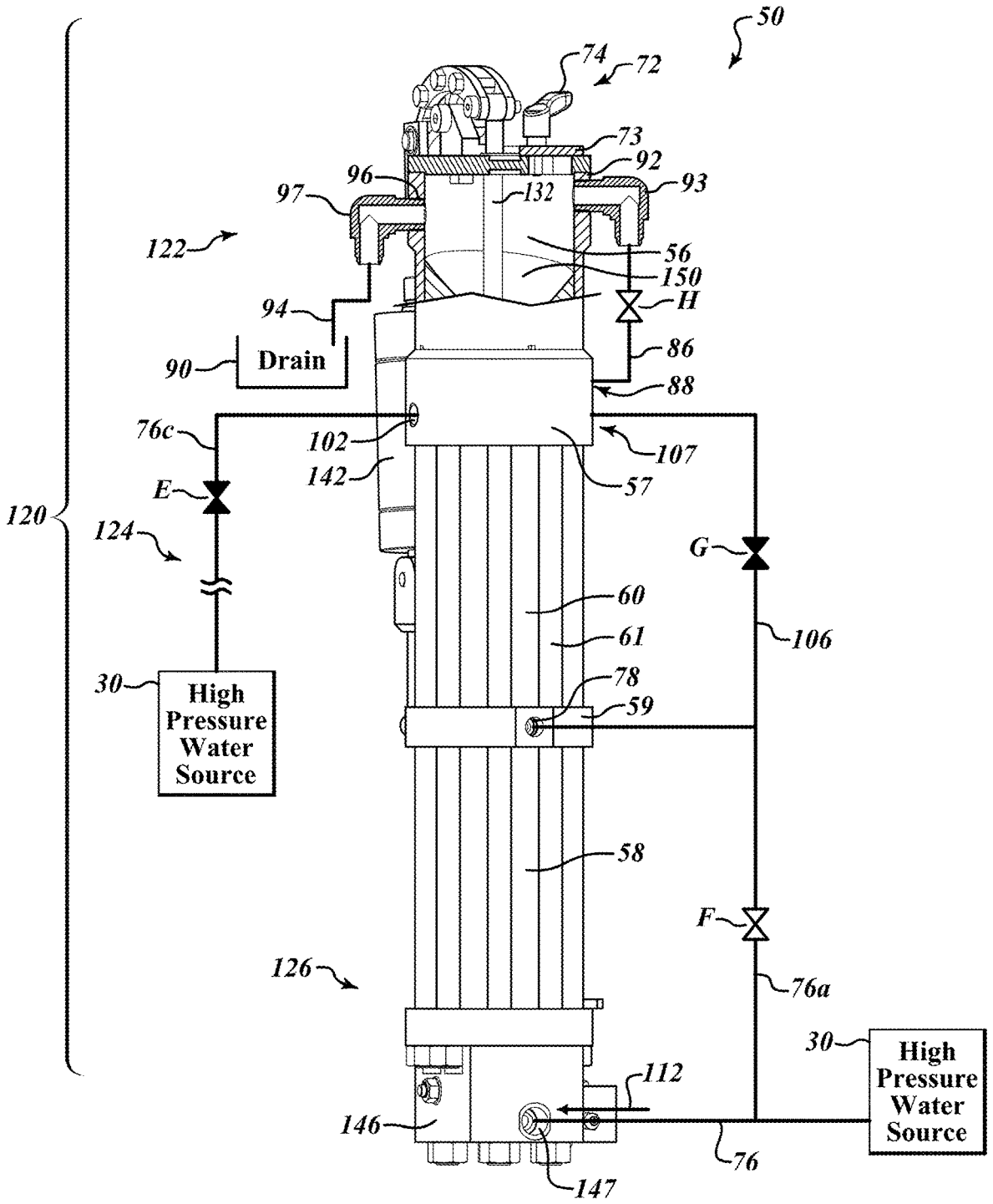
FIG. 7 is a partial cross-sectional view of the abrasive slurry delivery system of FIG. 3 taken along line 7-7 of FIG. 4.

As shown best in FIG. 6, the shuttle chamber 60 of the vessel assembly 120 is in fluid communication with a vent or outlet port 88 coupled to an auxiliary return line 86 having a dump valve H that is controllable to selectively release pressure from the shuttle chamber 60 to prepare the shuttle chamber 60 to receive abrasives 54 from the storage chamber 56. In the example embodiment shown in FIG. 6, the shuttle chamber 60 is shown as being vented to a drain 90 via the intermediary of the storage chamber 56. For this purpose, the auxiliary return line 86 is coupled to an inlet port 92 of the storage chamber 56 via a suitable fitting 93 and a separate drain line 94 is provided between the drain 90 and a suitable fitting 97 at an outlet or vent port 96 of the storage chamber 56 to route vented matter away from the abrasive slurry delivery system 50.

The shuttle chamber 60 may further include inlet or pressure port 102 for attachment to a high pressure supply line 76*c* in fluid communication with the high pressure water source 30 to selectively receive high pressure water during operation. A pressure supply valve E may be provided within the high pressure supply line 76*c* to selectively control the supply of high pressure water, the pressure supply valve E being in an open position when the abrasive slurry delivery system 50 is configured to dose abrasives 54 from the shuttle chamber 60 to the discharge chamber 58. One or more orifices J, restrictors or other flow control devices may also be provided within the high pressure supply line 76*c* to control, manipulate or regulate the flow of high pressure water to the shuttle chamber 60.

Additionally, a return line 106 may be provided between the discharge chamber 58 and the shuttle chamber 60 to enable water or a mixture of water and abrasives to return to the shuttle chamber 60 during a discharge chamber 58 filling process. A return valve G is provided within the return line 106 for this purpose, namely to selectively enable water or a mixture of water and abrasives to return to the shuttle chamber 60. When high pressure water is supplied to the shuttle chamber (i.e., when pressure supply valve E is open), the pressure differential across the transfer valve B is minimized or substantially eliminated, and as such, the high pressure mixture of water and abrasives 54' in the shuttle chamber 60 may be readily transferred to the discharge chamber 58.

The discharge chamber 58 may include an inlet or supply port 78 to introduce high pressure water into the discharge chamber 58 during at least a portion of operation. The inlet or supply port 78 may be located within an upper end of the discharge chamber 58 and may be coupled to the high pressure source 30 via a supply line branch 76*a*. A supply valve F may be provided in the supply line branch 76*a* to control the supply of high pressure water to the discharge chamber 58. During normal cutting operation, the supply valve F is maintained in an open position to continuously supply high pressure water to the discharge chamber 58 irrespective of the stage of the abrasive dosing operation. Accordingly, the abrasive slurry delivery system 50 may continuously supply abrasive slurry as needed to cut or otherwise process a workpiece 14 while abrasives 54, 54' are sequentially dosed through the system 50.

As can be appreciated from FIGS. 3 through 7, the storage chamber 56, the shuttle chamber 60 and the discharge chamber 58 may be fixedly coupled together to form a rigid, multi-stage vessel. In some instances, the multi-stage vessel may be an elongated, generally cylindrical vessel having three distinct stages arranged in a generally collinear manner. The chambers 56, 58, 60 may be positioned relatively close together or may be spaced apart with intermediate structures therebetween. Separate or integral manifolds 57, 59 may be provided between the chambers 56, 58, 60 with one or more of the various ports described herein (e.g., ports 78, 88, 102, 107) to enable fluid communication between and among the chambers 56, 58, 60 as described. In addition, or alternatively, one or more of the various ports (e.g., ports 92, 96), may be provided directly in a sidewall or other structure defining each chamber 56, 58, 60. One or more seal devices may be provided between the chambers 56, 58, 60 and other components of the assembly when provided (e.g., manifolds 57, 59) to provide a sealed environment at least within the shuttle chamber 60 and the discharge chamber 58 which is sufficient to receive high pressure water (e.g., 40,000 psi or higher) during operation. To assist in maintaining an appropriately sealed environment, a plurality of tie rods 61 or other biasing structures may be arranged to compressively sandwich the shuttle chamber 60 between the storage chamber 56 and the discharge chamber 58.

A manifold 146 may be provided at the lower end 126 of the vessel assembly 120 downstream of or integral with the discharge chamber 58. The manifold 146 may house or include the outlet 64 of the discharge chamber 58 and the metering valve C. In addition, the manifold 146 may include an inlet port 147 coupled to the high pressure water source 30 via the high pressure water supply line 76 and an outlet port 148 for discharging the flow of high pressure water along with the mixture of high pressure water and abrasives 54' selectively discharged through the metering valve C for further admixture and delivery to a nozzle 23 of the cutting head 22. In addition, a high pressure water supply branch 76*b* may be formed or otherwise provided within the manifold 146 for routing high pressure water through a riser conduit 80 that terminates within an upper region of the discharge chamber 58 to introduce high pressure water into the upper region of the discharge chamber 58 during operation.

In some embodiments, one or more of the chambers 56, 58, 60 may be flexibly coupled to the other chambers 56, 58 and 60 and/or located remotely with respect to each other. The chambers 56, 58, 60 may have the same or different internal capacities and may vary in shape and size from each other. Although each of the chambers 56, 58, 60 is shown as having a generally cylindrical profile, each of the chambers 56, 58, 60 may have profiles of other regular or irregular shapes. In addition, one or more of the storage chamber 56, the shuttle chamber 60 and the discharge chamber 58 may include a tapered surface 150, 152, 154 at a respective lower end thereof to funnel the abrasives or the high pressure mixture of water and abrasives downstream. At least the shuttle chamber 60 and the discharge chamber 58 may be configured to receive high pressure water of without appreciable permanent deformation. For example, the shuttle chamber 60 and the discharge chamber 58 may be of sufficient strength to contain water at least 40,000 psi without appreciable permanent deformation thereof.

Figure 5:
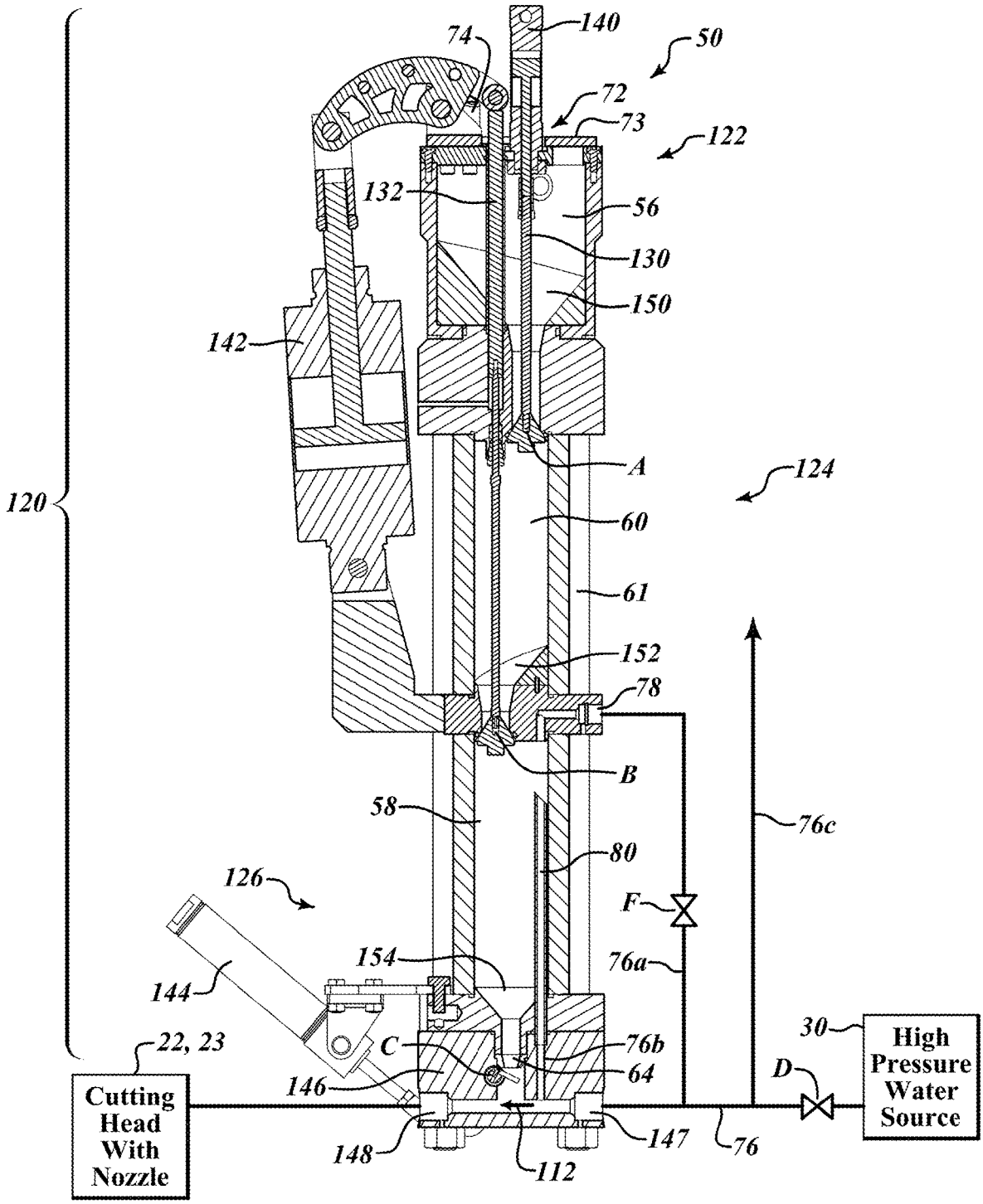
FIG. 5 is a cross-sectional view of the abrasive slurry delivery system of FIG. 3 taken along line 5-5 of FIG. 4.

As shown best in FIG. 5, the vessel assembly 120 includes a first transfer valve A between the storage chamber 56 and the shuttle chamber 60 and a second transfer valve B between the shuttle chamber 60 and the discharge chamber 58. These transfer valves A, B may be communicatively coupled to a control system 28 (FIG. 1) to sequentially open and close the valves A, B to dose the abrasives 54 from the storage chamber 56 to the discharge chamber 58 via the shuttle chamber 60 during operation. The first transfer valve A is controllable to selectively isolate the shuttle chamber 60 from the storage chamber 56 and the second transfer valve B is controllable to selectively isolate the shuttle chamber 60 from the discharge chamber 58. The control system 28 may also operate the metering device C, which is coupled to the discharge chamber 58 to selectively discharge the high pressure mixture of water and abrasives 54' from the discharge chamber 58. The control system 28 may vary the rate at which the high pressure mixture of water and abrasives 54' is discharged based on numerous variables, including, for example, a travel speed of the cutting head 22 or the thickness or the type of material that is being processed.

Each of the transfer valves A, B may be controlled or actuated via a respective valve rod 130, 132 extending through the vessel assembly 120 to a respective pneumatic or hydraulic actuator 140, 142 positioned external to the internal chambers 56, 58, 60. In addition, a pneumatic or hydraulic actuator 144 may be provided to adjustably control the metering valve C at the outlet 64 of the discharge chamber 58. The pneumatic or hydraulic actuators 140, 142, 144 may be coupled directly to the vessel assembly 120 to be manipulated in space therewith. The pneumatic or hydraulic actuators 140, 142, 144 may be sized according to the different operational loading conditions expected within the chambers 56, 58, 60 during use. Although not shown entirely in FIGS. 3 through 7, it will be appreciated by those of ordinary skill in the art, that appropriate fluid conduits, fittings, etc. may be provided in communication with the pneumatic or hydraulic actuators 140, 142, 144 and a working fluid (e.g., compressed air) may be controlled by the control system 28 (FIG. 1) to enable coordinated actuation of the transfer valves A, B and the metering valve C during operation. Further, although the transfer valves A, B and metering valve C are illustrated as being actuated by a respective pneumatic or hydraulic actuator 140, 142, 144, it is appreciated that other mechanisms may be provided in lieu of those shown. For example, one or more multi-positional valves controlled via one or more respective solenoids may be provided to enable the desired functionality described herein.

As can be appreciated from the above descriptions and corresponding figures, the abrasive slurry delivery systems 50, 52 described herein are specifically adapted to supply an abrasive slurry to generate a high pressure or ultrahigh pressure abrasive slurry jet in a relatively compact and efficient form factor or package. In some embodiments, for example, a vessel assembly 120 of the abrasive slurry delivery system 50 may be substantially contained within a cylindrical working envelope having a longitudinal height of about thirty-six inches and a diameter of about ten inches, while nevertheless being able to continuously supply a mixture of high pressure water and abrasives 54' at a sufficient volumetric flow rate to be further mixed with high pressure water and passed through an orifice of a nozzle 23 of a cutting head 22 to generate an abrasive slurry jet. This can be particularly advantageous by enabling the abrasive slurry delivery system 50 to be mounted to a motion or positional system to move in unison with the cutting head 22 with respect to one or more translational or rotational axes thereof.

U.S. provisional patent application Ser. No. 61/919,554 filed Dec. 20, 2013, is incorporated herein by reference, in its entirety.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An abrasive slurry jet cutting system comprising:

a cutting head including a nozzle configured to receive a flow of abrasive slurry and generate an abrasive slurry jet during a processing operation; and a vessel assembly configured to discharge a mixture of water and abrasives for further admixture with a flow of water to form the flow of abrasive slurry, the vessel assembly including:

a storage chamber to house abrasives;

a discharge chamber having an outlet to selectively discharge the mixture of water and abrasives into the flow of water and toward the nozzle of the cutting head during the processing operation, the discharge chamber having a supply port;

a supply branch coupling the flow of water to the supply port;

a shuttle chamber positioned downstream of the storage chamber and upstream of the discharge chamber to intermittently receive the abrasives from the storage chamber and to intermittently supply the abrasives to the discharge chamber via a supply line, the shuttle chamber coupled to a source of water to intermittently supply water to the shuttle chamber to intermittently pressurize the shuttle chamber to create the mixture of water and abrasives to be transferred to the discharge chamber; and a return line coupling the discharge chamber, via the supply port, to the shuttle chamber such that a path, remote from the supply line, is provided for at least one of water and abrasives in the discharge chamber to the shuttle chamber.

2. The abrasive slurry jet cutting system of claim 1 wherein the storage chamber, the shuttle chamber and the discharge chamber are fixedly coupled together to form a multi-stage vessel.

3. The abrasive slurry jet cutting system of claim 2, further comprising: a positioning system coupled to the cutting head to manipulate the cutting head in space, and wherein the multi-stage vessel is attached to the positioning system.

4. The abrasive slurry jet cutting system of claim 3 wherein the multi-stage vessel is attached to the positioning system such that the multi-stage vessel remains in close proximity to the cutting head during movement of the cutting head.

5. The abrasive slurry jet cutting system of claim 4 wherein the positioning system includes a robotic arm and the multi-stage vessel is attached to the robotic arm.

6. The abrasive slurry jet cutting system of claim 4 wherein the positioning system includes a carriage movably coupled to a bridge, and wherein the cutting head and the multi-stage vessel are coupled to the carriage to move therewith.

7. The abrasive slurry jet cutting system of claim 1, further comprising: an abrasive hopper coupled to the storage chamber of the vessel assembly to supply abrasives to the storage chamber.

8. The abrasive slurry jet cutting system of claim 1 wherein:

the mixture of water and abrasives is a mixture of water and abrasives of at least 2,000 psi;

the flow of water is a flow of water of at least 2,000 psi; and the source of water is a source of water of at least 2,000 psi.

9. The abrasive slurry jet cutting system of claim 8 wherein the vessel assembly includes a first valve between the storage chamber and the shuttle chamber and a second valve between the shuttle chamber and the discharge chamber, and wherein the abrasive slurry jet system further comprises: a control system communicatively coupled to each of the first valve and the second valve to sequentially open and close the first valve and the second valve to dose the abrasives from the storage chamber to the discharge chamber via the shuttle chamber.

10. The abrasive slurry jet cutting system of claim 9 wherein the shuttle chamber of the vessel assembly includes an outlet port coupled to a dump valve, and wherein the control system is communicatively coupled to the dump valve to control the dump valve to selectively release pressure from the shuttle chamber to prepare the shuttle chamber to receive the abrasives from the storage chamber.

11. The abrasive slurry jet cutting system of claim 9 wherein the shuttle chamber of the vessel assembly includes an inlet port coupled to a pressure supply valve, and wherein the control system is communicatively coupled to the pressure supply valve to control the pressure supply valve to intermittently supply water to the shuttle chamber to intermittently pressurize the shuttle chamber to create the mixture of water and abrasives to be transferred to the discharge chamber.

12. The abrasive slurry jet cutting system of claim 9 wherein the discharge chamber of the vessel assembly is coupled to a metering device, and wherein the control system is communicatively coupled to the metering device to control the metering device to selectively discharge the mixture of water and abrasives into the flow of water to form the flow of abrasive slurry.

13. The abrasive slurry jet cutting system of claim 8 wherein the flow of water to form the flow of abrasive slurry is supplied to the outlet of the discharge chamber at a pressure of at least 40,000 psi.

14. A vessel assembly configured to discharge a mixture of water and abrasives for admixture with a flow of water for generating an abrasive slurry, the vessel assembly comprising:

a storage chamber to temporarily store abrasives;

a discharge chamber having an outlet to selectively discharge the mixture of water and abrasives into the flow of water to mix therewith and generate the abrasive slurry, the discharge chamber having a supply port;

a supply branch coupling the flow of water to the supply port;

a shuttle chamber positioned downstream of the storage chamber and upstream of the discharge chamber to intermittently receive the abrasives from the storage chamber and to intermittently supply the abrasives mixed with water to the discharge chamber via a supply line, the shuttle chamber including an inlet port coupleable to a source of water to intermittently receive the water and intermittently pressurize the shuttle chamber to create the mixture of water and abrasives to be transferred to the discharge chamber; and a return line coupling the discharge chamber, via the supply port, to the shuttle chamber such that a path, remote from the supply line, is provided for at least one of water and abrasives in the discharge chamber to the shuttle chamber.

15. The vessel assembly of claim 14 wherein the storage chamber, the shuttle chamber and the discharge chamber are fixedly coupled together to form a multi-stage vessel.

16. The vessel assembly of claim 15 wherein the multi-stage vessel is an elongated, generally cylindrical vessel having three distinct stages arranged in a generally collinear manner.

17. The vessel assembly of claim 14 wherein the discharge chamber includes a water conduit terminating within an upper region of the discharge chamber, such that the water conduit introduces water of at least 2,000 psi into the upper region of the discharge chamber during operation.

18. The vessel assembly of claim 14 wherein the supply port is located within an upper end of the discharge chamber to introduce water between 2,000 psi and 75,000 psi into the upper end of the discharge chamber during operation.

19. The vessel assembly of claim 14, further comprising: a plurality of tie rods arranged to compressively sandwich the shuttle chamber between the storage chamber and the discharge chamber.

20. The vessel assembly of claim 14 wherein:

the mixture of water and abrasives is a mixture of water and abrasives of at least 2,000 psi;

the flow of water is a flow of water of at least 2,000 psi; and the source of water is a source of water of at least 2,000 psi.

21. The vessel assembly of claim 20, further comprising: a first valve provided between the storage chamber and the shuttle chamber to selectively isolate the shuttle chamber from the storage chamber; and a second valve provided between the shuttle chamber and the discharge chamber to selectively isolate the shuttle chamber from the discharge chamber.

22. The vessel assembly of claim 21, further comprising: a metering device coupled to the discharge chamber to selectively discharge the mixture of water and abrasives from the discharge chamber.

23. The vessel assembly of claim 21 wherein each of the first valve and the second valve is controlled via a respective valve rod extending through the vessel assembly.

24. The vessel assembly of claim 21, further comprising: a first pneumatic or hydraulic actuator coupled to the first valve and a second pneumatic or hydraulic actuator coupled to the second valve to selectively unseat the valves during operation.

25. The vessel assembly of claim 20 wherein each of the storage chamber, the shuttle chamber and the discharge chamber includes a tapered surface at a respective lower end thereof to funnel the abrasives or the mixture of water and abrasives downstream.

26. The vessel assembly of claim 20 wherein at least the shuttle chamber and the discharge chamber are configured to receive water of at least 40,000 psi without permanent deformation.

27. The method of claim 20 wherein transferring the abrasives from the storage chamber to the shuttle chamber and transferring the mixture of water and abrasives from the shuttle chamber to the discharge chamber includes dosing abrasives in a sequential manner from the storage chamber to the discharge chamber via the shuttle chamber.

28. A method of forming an abrasive slurry to be passed through a nozzle to generate an abrasive slurry jet, the method comprising:

introducing abrasives into a storage chamber;

depressurizing a shuttle chamber downstream of the storage chamber to prepare the shuttle chamber to receive the abrasives from the storage chamber;

transferring the abrasives from the storage chamber to the shuttle chamber;

isolating the shuttle chamber from the storage chamber;

introducing water into the shuttle chamber to pressurize the shuttle chamber while isolated from the storage chamber to create a mixture of water and abrasives;

transferring the mixture of water and abrasives from the shuttle chamber to a discharge chamber downstream of the shuttle chamber;

transferring at least one of water and abrasives from the discharge chamber to the shuttle chamber via a return line connected to a supply port of the discharge chamber;

discharging the mixture of water and abrasives from the discharge chamber into a flow of water to mix therewith and form the abrasive slurry; and supplying water from the flow of water to the discharge chamber via a supply branch, the supply branch connecting to the flow of water, at a location upstream of where the mixture of water and abrasives is discharged into the flow of water, to the supply port of the discharge chamber.

29. The method of claim 28 wherein transferring the abrasives from the storage chamber to the shuttle chamber occurs with substantially no differential pressure between the storage chamber and the shuttle chamber.

30. The method of claim 28, further comprising:

maintaining the storage chamber at atmospheric pressure during an operation; and maintaining the discharge chamber at no less than 2,000 psi during the operation.

31. The method of claim 28 wherein transferring the abrasives from the storage chamber to the shuttle chamber includes transferring abrasives in a dry condition.

32. The method of claim 28 wherein:

introducing water into the shuttle chamber to pressurize the shuttle chamber includes introducing water of at least 2,000 psi into the shuttle chamber;

introducing the water into the shuttle chamber creates a mixture of water and abrasives of at least 2,000 psi; and discharging the mixture of water and abrasives from the discharge chamber includes discharging the mixture of water and abrasives from the discharge chamber into a flow of water of at least 2,000 psi to mix therewith and form the abrasive slurry.

33. The method of claim 32 wherein transferring the mixture of water and abrasives from the shuttle chamber to the discharge chamber occurs with substantially no differential pressure between the shuttle chamber and the discharge chamber.

34. A method of processing a workpiece using an abrasive slurry jet, the method comprising:

dosing abrasives through a vessel assembly having a shuttle chamber provided between a storage chamber and a discharge chamber, the shuttle chamber coupled to a source of water to enable intermittent pressurization of the shuttle chamber to create a mixture of water and abrasives while dosing the abrasives, the discharge chamber coupled to the source of water via a supply branch and a supply port, and the discharge chamber coupled to the shuttle chamber by a return line providing a path for at least one of water and abrasives in the discharge chamber to the shuttle chamber, via the supply port;

mixing the mixture of water and abrasives from the vessel assembly into a flow of water to form an abrasive slurry;

passing the abrasive slurry through a nozzle to generate the abrasive slurry jet; and impinging the workpiece with the abrasive slurry jet.

35. The method of claim 34 wherein:

the abrasive slurry jet is an abrasive slurry jet of at least 2,000 psi;

the source of water is a source of water of at least 2,000 psi;

the mixture of water and abrasives is a mixture of water and abrasives of at least 2,000 psi; and the flow of water is a flow of water of at least 2,000 psi.

* * * * *